US011414106B2

(12) United States Patent
Ren et al.

(10) Patent No.: US 11,414,106 B2
(45) Date of Patent: Aug. 16, 2022

(54) SUSPENSION SYSTEM, BOGIE ASSEMBLY WITH SAME, AND RAIL VEHICLE

(71) Applicant: BYD COMPANY LIMITED, Shenzhen (CN)

(72) Inventors: Lin Ren, Shenzhen (CN); Daolin Li, Shenzhen (CN); Zhicheng Tan, Shenzhen (CN)

(73) Assignee: BYD COMPANY LIMITED, Shenzhen (CN)

( * ) Notice: Subject to any disclaimer, the term of this patent is extended or adjusted under 35 U.S.C. 154(b) by 820 days.

(21) Appl. No.: 16/334,386

(22) PCT Filed: Feb. 28, 2017

(86) PCT No.: PCT/CN2017/075227

§ 371 (c)(1),
(2) Date: Mar. 19, 2019

(87) PCT Pub. No.: WO2018/054019

PCT Pub. Date: Mar. 29, 2018

(65) Prior Publication Data

US 2021/0309267 A1 Oct. 7, 2021

(30) Foreign Application Priority Data

Sep. 21, 2016 (CN) ..... 201610839705.1

(51) Int. Cl.
*B61F 5/52* (2006.01)
*B61F 5/08* (2006.01)
*B61F 5/12* (2006.01)

(52) U.S. Cl.
CPC ..... *B61F 5/08* (2013.01); *B61F 5/125* (2013.01); *B61F 5/52* (2013.01)

(58) Field of Classification Search
CPC .... B61F 5/08; B61F 5/125; B61F 5/52; B61F 5/02; B61F 5/04; B61F 3/00; B61F 3/16;
(Continued)

(56) References Cited

U.S. PATENT DOCUMENTS 3,143,977 A * 8/1964 Deller ..... B61B 13/04 105/144
3,646,893 A * 3/1972 Sundby ..... B61F 1/14 105/182.1

(Continued)

FOREIGN PATENT DOCUMENTS

CN 201021148 Y 2/2008
CN 201296254 Y 8/2009

(Continued)

OTHER PUBLICATIONS

The World Intellectual Property Organization (WIPO) International Search Report for PCT/CN2017/075227 dated May 5, 2017 5 Pages.

*Primary Examiner* — Mark T Le
(74) *Attorney, Agent, or Firm* — Anova Law Group, PLLC

(57) ABSTRACT

An apparatus includes a suspension system, a bogie frame with the same, and a rail vehicle. The suspension system includes a vehicle body connecting seat, an elastic component, a transverse damper and a vertical damper. The vehicle body connecting seat is positioned above the elastic component and is connected to the elastic component, and the transverse damper and the vertical damper are respectively hinged to the vehicle body connecting seat and are perpendicular to each other.

17 Claims, 8 Drawing Sheets

(58) Field of Classification Search
CPC ..... B61F 5/12; B61F 5/308; B60G 13/003; B60G 2300/10; B60Y 2200/30; B60Y 2400/86
See application file for complete search history.

(56) References Cited

U.S. PATENT DOCUMENTS

| | | | | |
|---|---|---|---|---|
| 8,316,775 | B2 * | 11/2012 | Timan | B61B 13/04 105/144 |
| 11,155,282 | B2 * | 10/2021 | Li | B61B 13/04 |
| 2009/0266268 | A1 * | 10/2009 | Timan | B61B 13/04 105/157.1 |

FOREIGN PATENT DOCUMENTS

| | | | |
|---|---|---|---|
| CN | 102963387 | A | 3/2013 |
| CN | 204605835 | U | 9/2015 |
| CN | 105197044 | A | 12/2015 |
| CN | 204915705 | U | 12/2015 |
| CN | 204978684 | U | 1/2016 |
| CN | 105416331 | A | 3/2016 |
| DE | 19513757 | C1 | 5/1996 |
| EP | 1894807 | A1 | 3/2008 |
| IN | 200802058 | I2 | 6/2009 |
| KR | 101236534 | B1 * | 2/2013 |

* cited by examiner

A

SUSPENSION SYSTEM, BOGIE ASSEMBLY WITH SAME, AND RAIL VEHICLE

CROSS-REFERENCE TO RELATED APPLICATIONS

This application is a national phase entry under 35 U.S.C. § 371 of International Application No. PCT/CN2017/075227, filed on Feb. 28, 2017, which claims a priority to and benefits of Chinese Patent Application Serial No. 201610839705.1, filed with the State Intellectual Property Office of P. R. China on Sep. 21, 2016, the entire content of all of which is incorporated herein by reference.

FIELD

The present disclosure relates to the technical field of rail vehicles and particularly relates to a suspension system, a bogie assembly with the suspension system, and a rail vehicle with the bogie assembly.

BACKGROUND

In related technologies, a rail vehicle includes a suspension system, and the suspension system can be used for eliminating the inclining tendency of the vehicle to ensure the traveling stability of the rail vehicle. However, the suspension system cannot realize multi-directional balance. For example, the suspension system cannot completely balance the rail vehicle in up-and-down, left-and-right and front-and-rear directions, so that a new suspension system for the rail vehicle is urgently needed.

SUMMARY

The present disclosure aims at resolving at least one of technical problems in related technologies at least to some extent. Therefore, the embodiments of the present disclosure provide a suspension system, which can ensure the stability of the vehicle body in up-and-down, left-and-right and front-and-rear directions.

The embodiments of the present disclosure also provide a bogie assembly.

The embodiments of the present disclosure further provide a vehicle.

The suspension system according to the embodiments of the present disclosure includes a vehicle body connecting seat, an elastic component, a transverse damper and a vertical damper. The vehicle body connecting seat is positioned above the elastic component and is connected to the elastic component, and the transverse damper and the vertical damper are respectively hinged to the vehicle body connecting seat and are perpendicular to each other.

The elastic component, the transverse damper and the vertical damper in the suspension system according to the embodiments of the present disclosure can ensure the stability of the rail vehicle in the traveling process along the up-and-down direction, the left-and-right direction and the front-and-rear direction together, and the suspension system can achieve damping and buffering effects, so that vibration or bumpiness of the rail vehicle in the traveling process can be reduced, and the traveling noise of the rail vehicle can be reduced.

In addition, the suspension system according to the embodiments of the present disclosure can also have the following additional technical features:

In some examples of the present disclosure, the transverse damper and the vertical damper are respectively positioned at two sides of the elastic component.

In some examples of the present disclosure, the suspension system also includes an elastic component limiting bracket, and the elastic component limiting bracket is connected to the vehicle body connecting seat and is positioned at one side of the elastic component.

In some examples of the present disclosure, the elastic component limiting bracket is hinged to the vehicle body connecting seat.

In some examples of the present disclosure, the elastic component limiting bracket is substantially triangular, the vertex of the elastic component limiting bracket is hinged to the vehicle body connecting seat, and the bottom edge of the elastic component limiting bracket is provided with a plurality of mounting holes for fasteners to penetrate through.

In some examples of the present disclosure, the elastic component limiting bracket is configured to be of a platy structure and is provided with a fastener avoiding hole.

In some examples of the present disclosure, the elastic component limiting bracket includes a limiting component body and a limiting component bottom plate, the upper end of the limiting component body is hinged to the vehicle body connecting seat, and the limiting component bottom plate is connected to the limiting component body and is provided with the mounting holes.

In some examples of the present disclosure, a support column is connected between the limiting component body and the limiting component bottom plate.

In some examples of the present disclosure, the vehicle body connecting seat includes an upper plate, a lower plate and a web plate, the web plate is vertically connected between the upper plate and the lower plate, the upper plate is suitable for being fixedly connected to the vehicle body, the lower plate is fixedly connected to the upper end of the elastic component, and the transverse damper and the vertical damper are respectively connected to the web plate.

In some examples of the present disclosure, the surface of the upper plate facing the vehicle body is provided with a buffer cushion, the shape of the buffer cushion is the same as the shape of the upper plate.

In some examples of the present disclosure, two web plates are arranged and are respectively a long web plate and a short web plate with different lengths, one end of the long web plate is hinged with the transverse damper, the other end of the long web plate and one end of the short web plate are both hinged to the vertical damper, and the one end of the short web plate is adjacent to the other end of the long web plate.

The bogie assembly according to the embodiments of the present disclosure includes a bogie frame, where the bogie frame includes a bogie body and a suspension support seat connected to the bogie body; and the suspension system according to the above embodiments of the present disclosure, where the lower end of the elastic component of the suspension system and the lower end of the vertical damper are respectively connected to the suspension support seat, and the transverse damper of the suspension system is connected to the bogie body.

The bogie assembly according to the embodiments of the present disclosure and the suspension system according to the embodiments of the present disclosure have the same beneficial effects, and will not be described in detail herein.

In addition, the bogie assembly according to the embodiments of the present disclosure can also have the following additional technical features:

In some examples of the present disclosure, two suspension support seats are arranged and are respectively connected to two opposite sides of the bogie body, and two suspension systems are arranged and are in one-to-one correspondence to two suspension support seats.

In some examples of the present disclosure, the two suspension systems are symmetrically arranged about the center of the bogie frame.

In some examples of the present disclosure, the bogie body is provided with a transverse stop mounting seat, the vehicle body connecting seat is provided with a suspension stop component corresponding to the transverse stop mounting seat, and the suspension stop component is suitable for being matched with the transverse stop mounting seat.

In some examples of the present disclosure, the surface of the short web plate back on to the long web plate is provided with a suspension stop component.

In some examples of the present disclosure, the bogie body is provided with an avoiding groove for avoiding the transverse damper.

In some examples of the present disclosure, the elastic component limiting bracket is fixedly connected to the suspension support seat.

In some examples of the present disclosure, a damping cushion is arranged at the lower end of the elastic component limiting bracket, and the damping cushion is fixedly connected to the suspension support seat.

The rail vehicle according to the embodiments of the present disclosure includes a vehicle body; and a bogie assembly according to the above embodiments of the present disclosure, where the vehicle body is mounted on the bogie assembly.

The rail vehicle according to the embodiments of the present disclosure and the bogie assembly according to the embodiments of the present disclosure have the same beneficial effects, and will not be described in detail herein.

Figure 1:
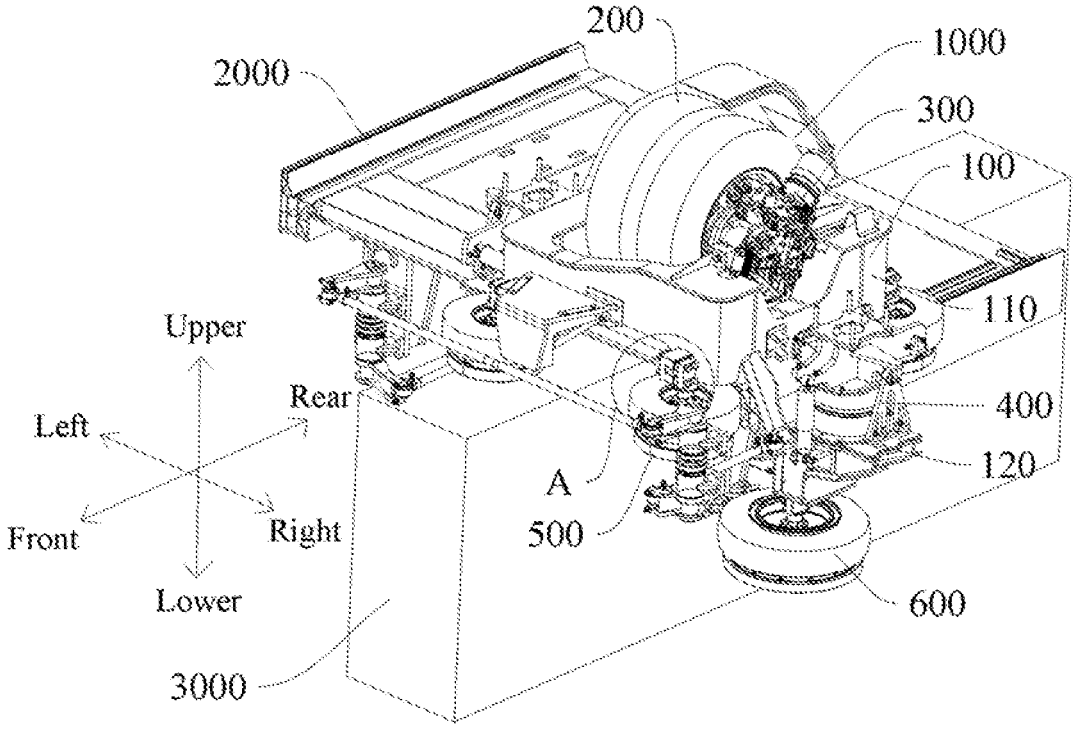
FIG. 1 is a structural schematic diagram of a bogie assembly, a vehicle body and a rail beam according to the embodiments of the present disclosure.

Drawing reference characters: bogie assembly 1000; bogie frame 100; traveling wheel mounting groove 101; electric assembly mounting groove 102; axial limiting component 103; radial limiting component 104; radial limiting component reinforcing rib 105; rail recess 106; reinforcing rib 107 of electric assembly mounting groove 102; vertical reinforcing rib 108; inclined reinforcing rib 109; bogie body 110; transverse stop mounting seat 111; first connecting beam 112; second connecting beam 113; third connecting beam 114; fourth connecting beam 115; avoiding groove 116 of bogie body 110; connecting beam reinforcing rib 117; horizontal wheel mounting seat reinforcing rib 118; top wall 112*a* of first connecting beam 112; bottom wall 112*b* of first connecting beam 112; outer side wall 112*c* of first connecting beam 112; inner side wall 112*d* of first connecting beam 112; suspension support seat 120; connecting reinforcing rib 121; guide wheel mounting seat 130; second pre-positioning component 131 of guide wheel mounting seat 130; steady wheel mounting seat 140; traveling wheel 200; electric assembly 300; suspension system 400; vehicle body connecting seat 410; suspension stop component 411; upper plate 412; lower plate 413; buffer cushion 414; long web plate 415; short web plate 416; elastic component 420; transverse damper 430; vertical damper 440; elastic component limiting bracket 450; damping cushion 451; limiting component body 452; limiting component bottom plate 453; guide wheel 500; guide wheel adjusting shim 510; guide wheel mounting block 520; first pre-positioning component 521 of guide wheel mounting block 520; steady wheel 600; steady wheel mounting block 610; vehicle body 2000; rail beam 3000.

DETAILED DESCRIPTION

The embodiments of the present disclosure are described in detail below. Examples of the embodiments are illustrated in the accompanying drawings. The embodiments described below with reference to the accompanying drawings are exemplary, and are used for explaining rather than limiting the present disclosure.

The bogie assembly 1000 according to the embodiments of the present disclosure is described in detail below with reference to the accompanying drawings. The bogie assembly 1000 can be applied to a rail vehicle, the rail vehicle also includes a vehicle body 2000, the vehicle body 2000 is mounted on the bogie assembly 1000, the rail vehicle can straddle on a single-track rail beam 3000 through the bogie assembly 1000, and the rail vehicle and the rail beam 3000 can form part of a rail traffic system.

As shown in FIG. 1 to FIG. 4, the bogie assembly 1000 may include a bogie frame 100, a suspension systems 400, a traveling wheel 200, an electric assembly 300, a guide wheels 500, a steady wheel 600 and a hauling mechanism, a rail recess 106 is formed on the bogie frame 100, and the rail recess 106 is matched on the rail beam 3000.

The bogie frame 100 may include a bogie body 110 and a suspension support seat 120 connected to the bogie body 110, the suspension systems 400 may be mounted between the suspension support seat 120 and the vehicle body 2000, and the bogie body 110 of the bogie frame 100 may be provided with a traveling wheel mounting groove 101 and an electric assembly mounting groove 102. The traveling wheel 200 is rotationally mounted in the traveling wheel mounting groove 101, That is, the traveling wheel 200 can rotate relative to the bogie frame 100 and the rail beam 3000. The electric assembly 300 is mounted in the electric assembly mounting groove 102, and the electric assembly 300 drives the traveling wheel 200 to rotate to realize the travel of the rail vehicle. The electric assembly 300 includes a motor assembly and a speed reducer, and the power output from the motor assembly is transmitted to the traveling wheel 200 through the speed reducer.

The guide wheel 500 is mounted on the bogie body 110, and the steady wheel 600 is mounted on the suspension support seat 120. A plurality of guide wheels 500 are provided and respectively arranged at two sides of the rail beam 3000, a plurality of steady wheels 600 are provided and respectively arranged at two sides of the rail beam 3000, and the peripheral surfaces of the guide wheel 500 and the steady wheel 600 abut against the rail beam 3000. In other words, when the rail vehicle is in a traveling state, the guide wheel 500 and the steady wheel 600 roll relative to the rail beam 3000, the guide wheel 500 can play a guiding role, and the steady wheel 600 can enhance the traveling stability of the rail vehicle on the rail beam 3000, so that the guide wheels 500 and the steady wheels 600 enable the rail vehicle to run stably and reliably.

The hauling mechanism is connected between the bogie frame 100 and the vehicle body 2000, and the bogie frame 100 can haul the vehicle body 2000 to move through the hauling mechanism, so that the rail vehicle can travel on the rail beam 3000.

The bogie frame 100 is firstly described below.

The bogie frame 100 includes a bogie body 110 and a suspension support seat 120. In some embodiments of the present disclosure, two suspension support seats 120 are arranged and connected to two opposite sides of the bogie body 110, and define a rail recess 106 together with the bogie body.

Figure 4:
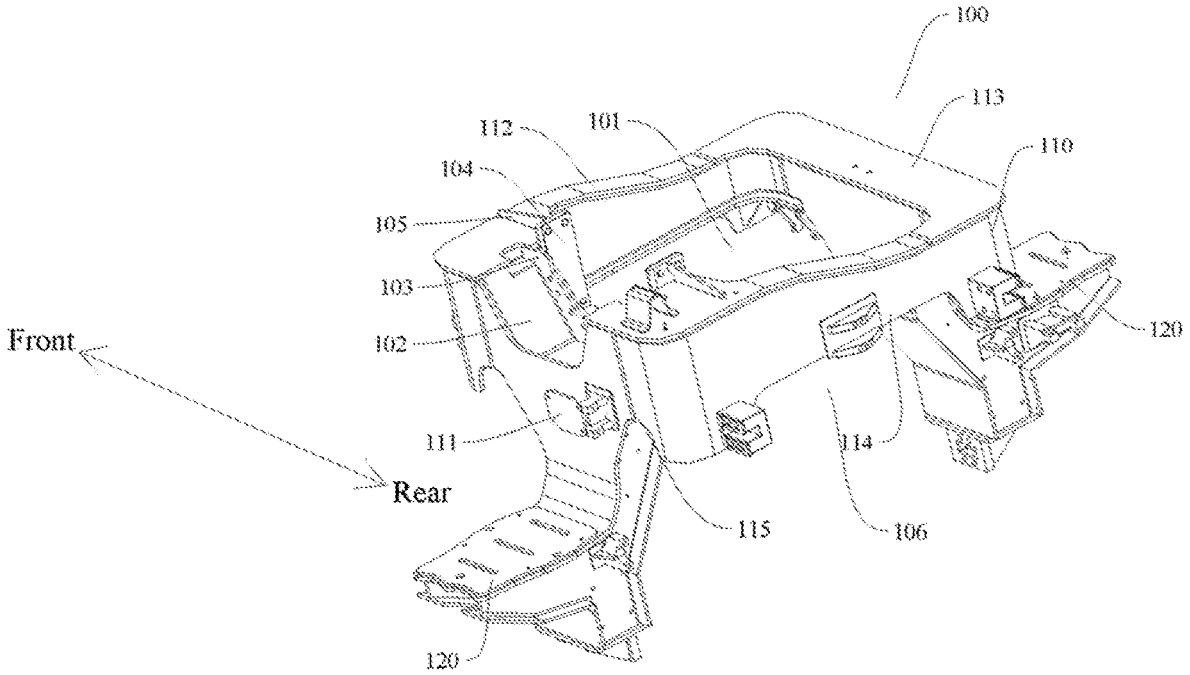
FIG. 4 is a three-dimensional view of the bogie frame.
Figure 6:
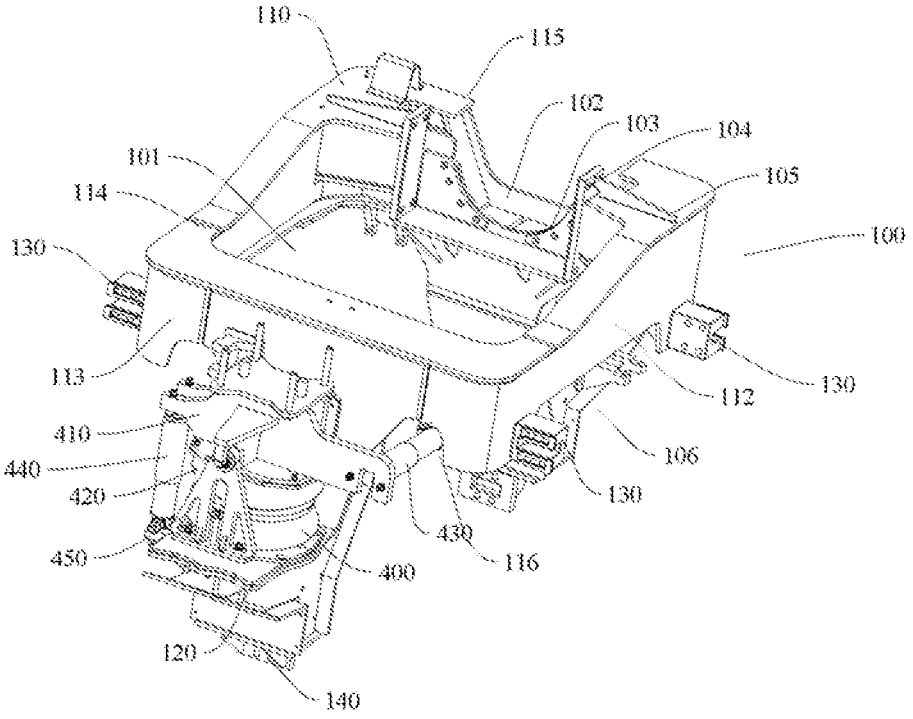
FIG. 6 is a three-dimensional view of the bogie frame and a suspension system.

As shown in FIG. 4 and FIG. 6, the bogie body 110 is substantially rectangular, the bogie body 110 may include a plurality of connecting beams which are connected end to end, and a middle region defined by the plurality of connecting beams is formed as a traveling wheel mounting groove 101. In some embodiments of the present disclosure, the bogie body 110 includes a first connecting beam 112, a second connecting beam 113, a third connecting beam 114 and a fourth connecting beam 115 which are sequentially connected end to end, the first connecting beam 112 and the third connecting beam 114 are oppositely arranged, and the second connecting beam 113 and the fourth connecting beam 115 are oppositely arranged.

Figure 9:
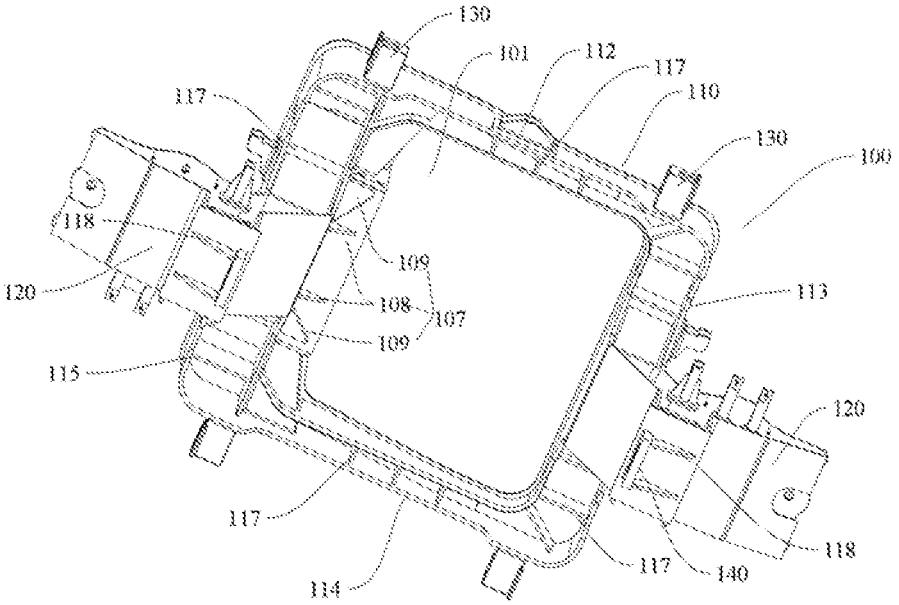
FIG. 9 is a three-dimensional view of the bogie frame.

As shown in FIG. 9, the first connecting beam 112, the second connecting beam 113, the third connecting beam 114 and the fourth connecting beam 115 are provided with connecting beam reinforcing ribs 117. The connecting beam reinforcing rib 117 can enhance the structural strength of the corresponding connecting beam, so that the structural strength of the bogie body 110 can be enhanced, and the structural reliability of the bogie assembly 1000 can be further enhanced.

The electric assembly mounting groove 102 is formed in the fourth connecting beam 115. For example, the electric assembly mounting groove 102 can be formed in the middle part of the fourth connecting beam 115. The upper end of the electric assembly mounting groove 102 is opened, so that the electric assembly 300 can be conveniently mounted in the electric assembly mounting groove 102. Furthermore, the electric assembly mounting groove 102 is communicated with the traveling wheel mounting groove 101, so as to facilitate the connection between the electric assembly 300 and the traveling wheel 200. In some embodiments of the present disclosure, the shape of the electric assembly mounting groove 102 is adaptive to the shape of the lower half of the electric assembly 300.

Figure 5:
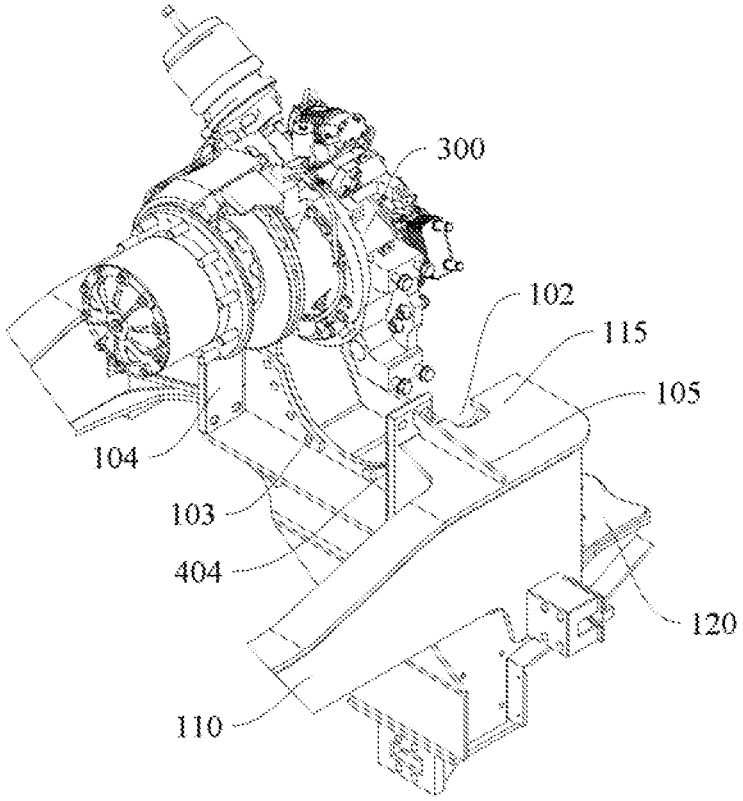
FIG. 5 is a partial schematic diagram of the electric assembly and the bogie frame.

As shown in FIG. 4 and FIG. 5, the electric assembly mounting groove 102 can be provided with an axial limiting component 103 and a radial limiting component 104, and the electric assembly 300 is fixedly connected to the axial limiting component 103 and the radial limiting component 104. The axial direction of the electric assembly 300 is the left-and-right direction as shown in FIG. 1, the axial limiting component 103 can limit the axial degree of freedom of the electric assembly 300, and the radial limiting component 104 can limit the radial degree of freedom of the electric assembly 300. It can be understood that when the rail vehicle travels on the rail beam 3000, the electric assembly 300 has a tendency of moving in the front-and-rear direction or the left-and-right direction relative to the bogie body 110 under the action of force, and the axial limiting component 103 and the radial limiting component 104 can ensure the mounting reliability of the electric assembly 300 in the electric assembly mounting groove 102 in the bogie frame 100, so that the structural reliability of the bogie assembly 1000 can be ensured.

As shown in FIG. 4 and FIG. 5, the axial limiting component 103 may be of a platy structure, the axial limiting component 103 is perpendicular to the axis of the electric assembly 300, the axial limiting component 103 is substantially in a U shape, the U-shaped axial limiting component 103 corresponds to and is matched with the mounting plate of the electric assembly 300, and a plurality of mounting holes are distributed in the extended direction (front-and-rear direction as shown in FIG. 4) of the axial limiting component 103. The axial limiting component 103 can be fixedly connected to the electric assembly 300 through a fastener, the fasteners may include a bolt and a nut, and the bolt can penetrate through the mounting hole in the electric assembly 300 and the mounting hole in the axial limiting component 103 and then is in threaded connection with the nut, so that the axial limiting component 103 and the electric assembly 300 can be mutually fixed. Because the axial limiting component 103 is perpendicular to the axis of the electric assembly 300, when the electric assembly 300 has a tendency of moving in the left-and-right direction, the axial limiting component 103 can prevent the tendency in time so as to ensure the mounting reliability of the electric assembly 300 in the electric assembly mounting groove 103.

As shown in FIG. 4 and FIG. 5, the radial limiting component 104 may be of a platy structure, two radial limiting components 104 may be arranged and are respectively positioned at two sides of the electric assembly 300, and the two radial limiting components 104 are respectively provided with mounting holes. Each radial limiting component 104 can extend in the up-and-down direction, each radial limiting component 104 is provided with two sets of mounting holes spaced apart up and down, and the number of each set of mounting holes is two. The platy radial limiting component 104 can be fixedly connected to the electric assembly 300 conveniently. In some embodiments of the present disclosure, the two radial limiting components 104 are symmetrically arranged about the axis of the electric assembly 300, so that the mounting reliability of the electric assembly 300 in the electric assembly mounting groove 102 can be enhanced.

In order to be fixedly connected to the electric assembly 300, the radial limiting component 104 extends upwards beyond the upper surface of the bogie frame 100. Furthermore, in order to ensure the reliability of the portion of the radial limiting component 104 beyond the upper surface of the bogie frame 100, in the embodiments as shown in FIG. 4 and FIG. 5, the upper surface of the bogie frame 100 is provided with a radial limiting component reinforcing rib 105 connected to the portion of the radial limiting component 104 beyond the upper surface of the bogie frame 100. The radial limiting component reinforcing rib 105 is configured to be platy, and the radial limiting component reinforcing rib 105 is perpendicular to the radial limiting component 104, so that the radial limiting component reinforcing rib 105 can better support and fix the radial limiting component 104.

The thickness of the fourth connecting beam 115 may be greater than the thickness of the second connecting beam 113. Because the electric assembly mounting groove 102 is formed in the fourth connecting beam 115, the electric assembly 300 is mounted on the fourth connecting beam 115. Under such condition, the structural strength of the fourth connecting beam 115 can be enhanced by reasonably increasing the thickness of the fourth connecting beam 115, so that the fourth connecting beam 115 can reliably fix the electric assembly 300, and further, the structural reliability of the bogie assembly 1000 can be enhanced.

In some embodiments of the present disclosure, two suspension support seats 120 are arranged and are respectively connected below the second connecting beam 113 and the fourth connecting beam 115, the distance between the upper surface of the second connecting beam 113 and the upper surface of the corresponding suspension support seat 120 is 480 mm to 660 mm, and the distance between the upper surface of the fourth connecting beam 115 and the upper surface of the corresponding suspension support seat 120 is 620 mm to 800 mm. In some embodiments of the present disclosure, the distance between the upper surface of the second connecting beam 113 and the upper surface of the corresponding suspension support seat 120 is 623 mm, and the distance between the upper surface of the fourth connecting beam 115 and the upper surface of the corresponding suspension support seat 120 is 759 mm. Therefore, the floor surface of the vehicle body 2000 is lower than the rotation axis of the traveling wheel 200 so as to enhance the traveling stability of the rail vehicle.

Figure 11:
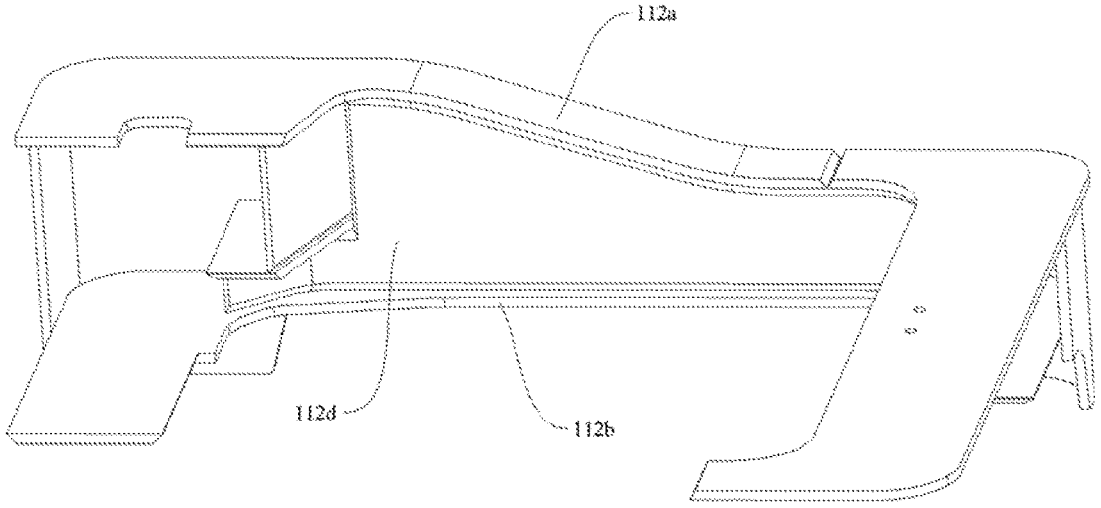
FIG. 11 is a partial structural schematic diagram of the bogie frame.
Figure 12:
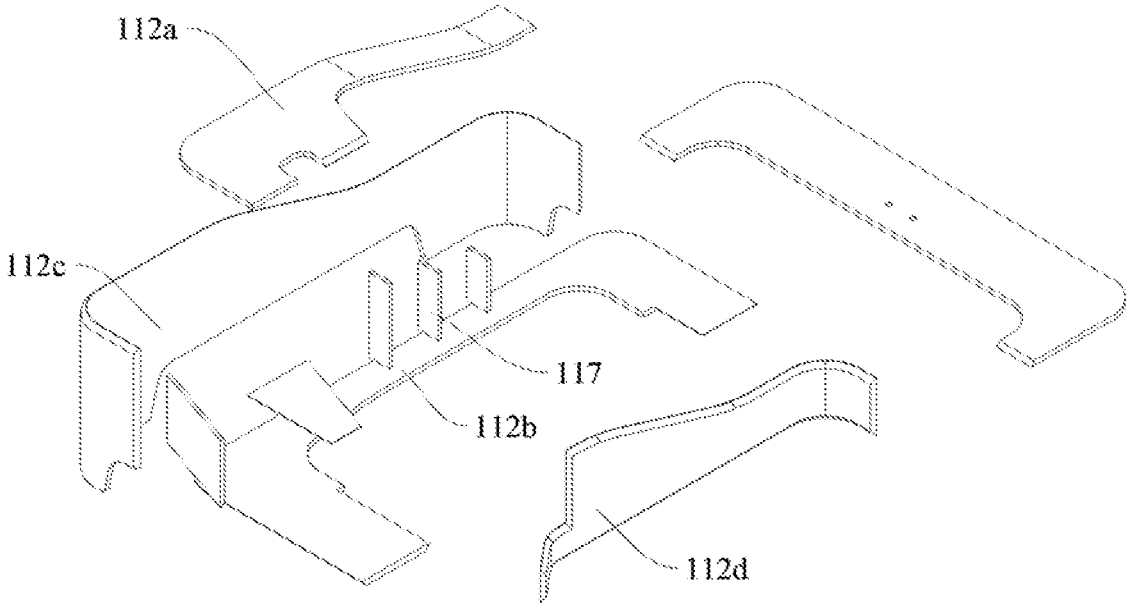
FIG. 12 is a partial explosive view of the bogie frame.

In the embodiments of the present disclosure, each connecting beam may include a top wall, a bottom wall, an outer side wall and an inner side wall. As shown in FIG. 11 and FIG. 12, taking the first connecting beam 112 as an example, the first connecting beam 112 includes a top wall 112*a*, a bottom wall 112*b*, an outer side wall 112*c* and an inner side wall 112*d*, the outer side wall 112*c* and the inner side wall 112*d* are connected between the top wall 112*a* and the bottom wall 112*b*, the outer side wall 112*c* and the inner side wall 112*d* are spaced apart in outer and inner directions, and a connecting beam reinforcing rib 117 is also connected between the outer side wall 112*c* and the inner side wall 112*d*. The outer side wall 112*c* and the inner side wall 112*d* can ensure the connecting strength between the top wall 112*a* and the bottom wall 112*b*, so that the structural strength of the connecting beam can be enhanced. Furthermore, the connecting beam reinforcing rib 117 can further enhance the structural strength of the connecting beam, so that the structural strength of the bogie frame 100 can be better improved, and the bogie frame 100 can better fix the electric assembly 300.

As shown in FIG. 4 and FIG. 6, the top wall 112*a* of the first connecting beam 112 and the top wall of the third connecting beam 114 can be connected between the top wall of the second connecting beam 113 and the top wall of the fourth connecting beam 115 in an arc shape. Thus, the top wall of the fourth connecting beam 115 is in natural connection and transition with the top wall of the second connecting beam 113 under the condition that the top wall of the fourth connecting beam 115 is higher than the top wall of the second connecting beam 113, so that the bogie body 110 can better fix the electric assembly 300, and the bogie body 110 has strong structural bearing capacity and high strength under the same material weight. In some embodiments of the present disclosure, the bottom walls of the first connecting beam 112, the second connecting beam 113, the third connecting beam 114 and the fourth connecting beam 115 may be positioned on the same plane.

As shown in FIGS. 4, 6, 11 and 12, the top wall 112*a* of the first connecting beam 112, the top wall of the second connecting beam 113 and the top wall of the third connecting beam 114 may be of a split structure, the top wall of the fourth connecting beam 115 is divided into two sections positioned at two sides of the electric assembly mounting groove 102, and the two sections of the top wall of the fourth connecting beam 115 are integrally formed with the top wall 112*a* of the first connecting beam 112 and the top wall of the third connecting beam 114 respectively. Thus, the top wall 112*a* of the whole bogie frame 100 is reasonable in structure, the manufacturing difficulty of the bogie frame 100 can be reduced, and the manufacturing efficiency of the bogie assembly 1000 can be enhanced.

Figure 10:
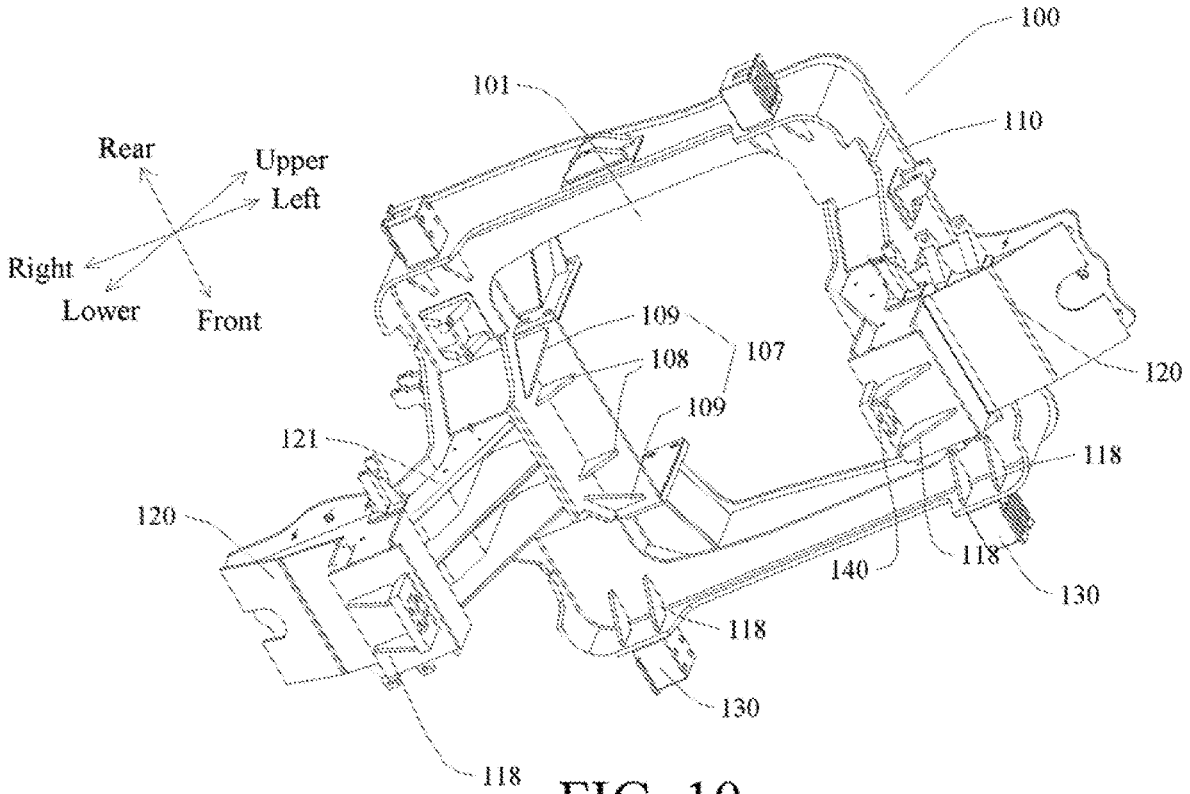
FIG. 10 is a three-dimensional view of the bogie frame.

As shown in FIG. 9 and FIG. 10, the end surface of the bottom wall of the electric assembly mounting groove 102 back on to the electric assembly 300 may be provided with a reinforcing structure. The reinforcing structure can effectively enhance the structural strength of the bottom wall of the electric assembly mounting groove 102, so that the electric assembly mounting groove 102 can better fix the electric assembly 300.

As shown in FIG. 9 and FIG. 10, the reinforcing structure may include a plurality of reinforcing ribs 107, and the plurality of reinforcing ribs 107 of the electric assembly mounting groove 102 may be spaced apart. For example, the plurality of reinforcing ribs 107 of the electric assembly mounting groove 102 may include vertical reinforcing ribs 108 and inclined reinforcing ribs 109, the vertical reinforcing ribs 108 may be perpendicular to the bottom wall of the electric assembly mounting groove 102, and the inclined reinforcing ribs 109 may be obliquely arranged relative to the bottom wall of the electric assembly mounting groove 102. Thus, the vertical reinforcing rib 108 can better enhance the structural strength of the bottom wall of the electric assembly mounting groove 102 in the up-and-down direction, and the inclined reinforcing rib 109 can better enhance the structural strength of the bottom wall of the electric assembly mounting groove 102 in the up-and-down direction and the front-and-rear direction, so that the reliability of the electric assembly 300 mounted in the electric assembly mounting groove 102 can be enhanced.

As shown in FIG. 9, two vertical reinforcing ribs 108 and two inclined reinforcing ribs 109 may be respectively arranged, the two vertical reinforcing ribs 108 are arranged between the two inclined reinforcing ribs 109, and the two inclined reinforcing ribs 109 are respectively arranged close to two edges of the bottom wall of the electric assembly mounting groove 102.

As shown in FIG. 10, the bogie frame 100 may be provided with a horizontal wheel mounting seat, and the horizontal wheel mounting seat can be used for mounting a horizontal wheel, where the horizontal wheel may include a guide wheel 500 and a steady wheel 600, and correspondingly, the horizontal wheel mounting seat may include a guide wheel mounting seat 130 and a steady wheel mounting seat 140. The bogie frame 100 is also provided with a horizontal wheel mounting seat reinforcing rib 118 corresponding to the horizontal wheel mounting seat, and the horizontal wheel mounting seat reinforcing rib 118 may include a guide wheel mounting seat reinforcing rib and a steady wheel mounting seat reinforcing rib. As shown in FIG. 10, two guide wheel mounting seat reinforcing ribs are arranged at the guide wheel mounting seat 130, and two steady wheel mounting seat reinforcing ribs are arranged at the steady wheel mounting seat 140.

Figure 8:
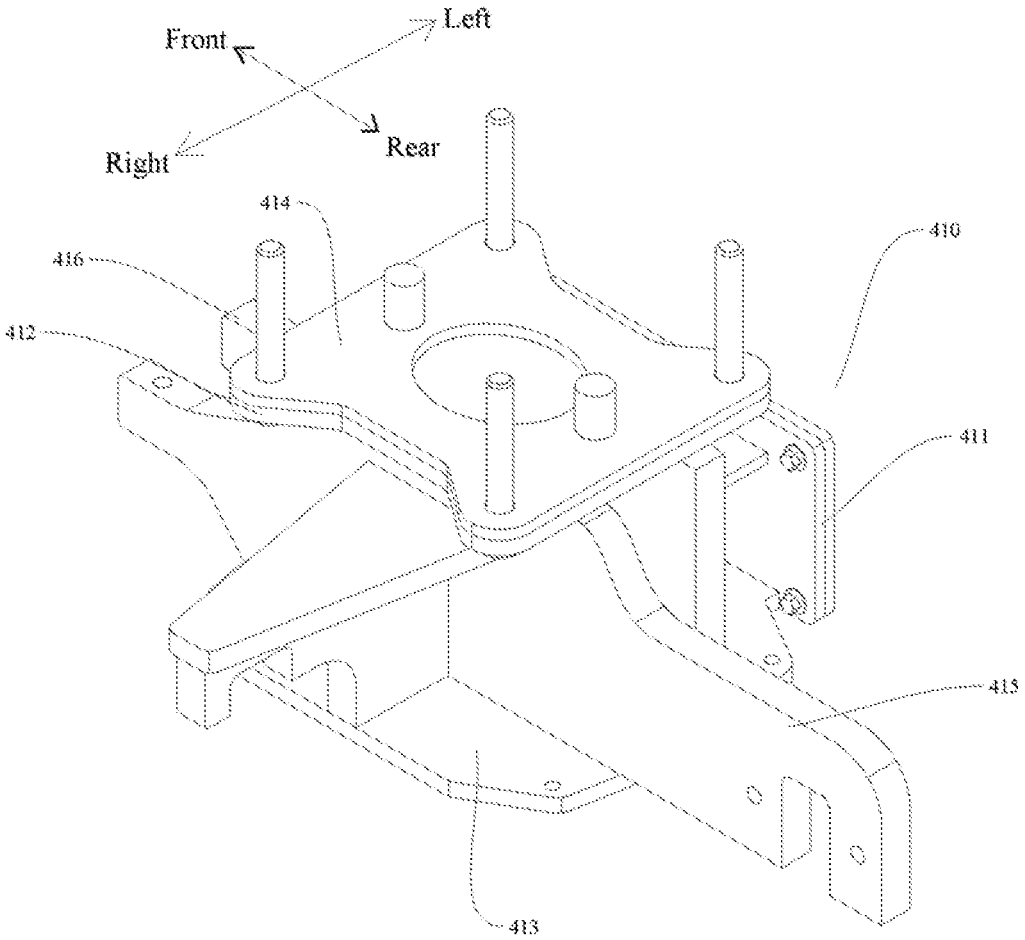
FIG. 8 is a three-dimensional view of a vehicle body connecting seat.

As shown in FIGS. 4 and 8, the bogie body 110 may be provided with a transverse stop mounting seat 111, the suspension system 400 mounted on the suspension support seat 120 is provided with a suspension stop component 411, and the suspension stop component 411 corresponds to and is suitable for being matched with the transverse stop mounting seat 111. In an embodiment, the transverse stop mounting seat 111 and the suspension stop component 411 are arranged oppositely, so that when the suspension system 400 offsets toward the bogie body 110, the suspension stop component 411 abuts against the transverse stop mounting seat 111, so that collision between the suspension system 400 and the bogie body 110 can be avoided, the suspension system 400 can be quickly reset, the inclining tendency of the rail vehicle can be eliminated, and further the structural reliability of the bogie assembly 1000 can be enhanced, and the service life of the bogie assembly 1000 can be prolonged.

As shown in FIG. 4, the suspension support seat 120 is substantially in a horizontal state, and smooth transition is adopted between the bogie body 110 and the suspension support seat 120, so that the transition between the bogie body 110 and the suspension support seat 120 is natural, the connection between the bogie body 110 and the suspension support seat 120 is reliable, and further, the structural reliability of the bogie frame 100 can be enhanced. The bottom of the suspension support seat 120 may also be provided with a reinforcing plate connected to the bottom of the bogie body 110. In addition, by virtue of smooth transition between the bogie body 110 and the suspension support seat 120, a sufficient insulation gap can be formed between the suspension system 400 and the rail beam 3000 so as to be used for insulation between the rail beam 3000 and a conductor rail, so that the structural reliability of the bogie assembly 1000 can be enhanced.

As shown in FIG. 10, the lower surface of the connected portion between each suspension support seat 120 and the bogie body 110 may be provided with a plurality of connecting reinforcing ribs 121 spaced apart. Each connecting reinforcing rib 121 extends along the connecting direction between the bogie body 110 and the suspension support seat 120, i.e., from the bogie body 110 to the suspension support seat 120, so that the connecting reinforcing ribs 121 can enhance the connecting strength between the bogie body 110 and the suspension support seat 120 at least to some extent, and further, the structural reliability of the bogie frame 100 can be enhanced.

The suspension system 400 is described in detail below.

Figure 3:
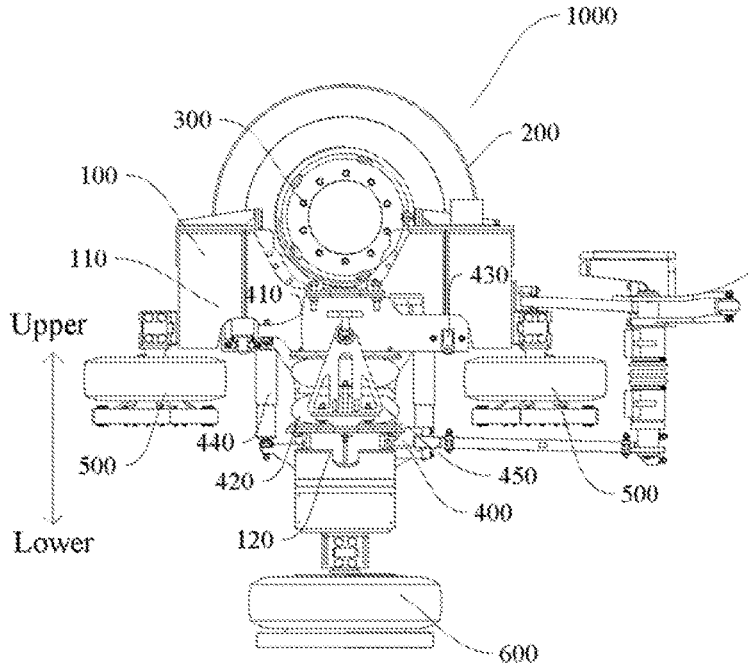
FIG. 3 is a side view of the bogie assembly according to the embodiments of the present disclosure.

As shown in FIG. 3 and FIG. 6, the suspension system 400 may include a vehicle body connecting seat 410, an elastic component 420, a transverse damper 430, a vertical damper 440 and an elastic component limiting bracket 450, the vehicle body connecting seat 410 is positioned above the suspension support seat 120, the vehicle body connecting seat 410 may be fixedly connected to the vehicle body 2000, and the elastic component 420 is connected between the vehicle body connecting seat 410 and the suspension support seat 120. In other words, the upper end of the elastic component 420 is connected to the vehicle body connecting seat 410, and the lower end of the elastic component 420 is connected to the suspension support seat 120. The transverse damper 430 is hinged between the vehicle body connecting seat 410 and the bogie body 110, the vertical damper 440 extends along the up-and-down direction, and the vertical damper 440 is hinged between the vehicle body connecting seat 410 and the suspension support seat 120. The elastic component limiting bracket 450 is connected between the vehicle body connecting seat 410 and the suspension support seat 120. Thus, the elastic component 420, the transverse damper 430 and the vertical damper 440 can ensure the stability of the rail vehicle in the traveling process along the up-and-down direction, the left-and-right direction and the front-and-rear direction, and the suspension system 400 can achieve damping and buffering effects together, so that vibration or bumpiness of the rail vehicle in the traveling process can be reduced, and the traveling noise of the rail vehicle can be reduced.

Each of the hinging mode between the transverse damper 430 and the bogie body 110, the hinging mode between the transverse damper 430 and the vehicle body connecting seat 410, the hinging mode between the vertical damper 440 and the vehicle body connecting seat 410 and the hinging mode between the vertical damper 440 and the suspension support seat 120 is a spherical hinge, so that the damping effect of the suspension system 400 can be enhanced, and the phenomenon of stress concentration can be prevented so as to enhance the reliability of the suspension system 400.

In some embodiments of the present disclosure, two suspension systems 400 may be provided and symmetrically arranged about the center of the bogie frame 100. That is, in the horizontal plane, one suspension system 400 rotates for 180° around the center of the bogie frame 100 to obtain another suspension system 400 so as to prevent the vehicle body 2000 from twisting in the horizontal plane, so that the stability of the rail vehicle in the traveling process can be enhanced.

For reasonable construction of the suspension system 400 and better work of the transverse damper 430 and the vertical damper 440, the transverse damper 430 and the vertical damper 440 may be respectively positioned at two sides of the elastic component 420. According to the embodiment as shown in FIG. 6, the bogie body 110 may be provided with an avoiding groove 116 for avoiding the transverse damper 430. Thus, the transverse damper 430 is simple and reasonable in arrangement, and the transverse damper 430 is reliably connected between the vehicle body connecting seat 410 and the bogie body 110.

Further, the elastic component limiting bracket 450 is hinged to the vehicle body connecting seat 410, and the elastic component limiting bracket 450 is fastened and connected to the suspension support seat 120 through a fastener. As shown in FIGS. 3 and 6, the upper end of the elastic component limiting bracket 450 is hinged to the vehicle body connecting seat 410 to avoid the phenomenon of stress concentration, so that rigid fracture of the elastic component limiting bracket 450 can be avoided to ensure the structural reliability of the suspension system 400. The elastic component limiting bracket 450 can effectively protect the elastic component 420 to prevent excessive deformation of the elastic component 420, so that the service life of the elastic component 420 can be prolonged. In some embodiments of the present disclosure, the elastic component 420 may be an air spring or a hourglass spring.

Figure 7:
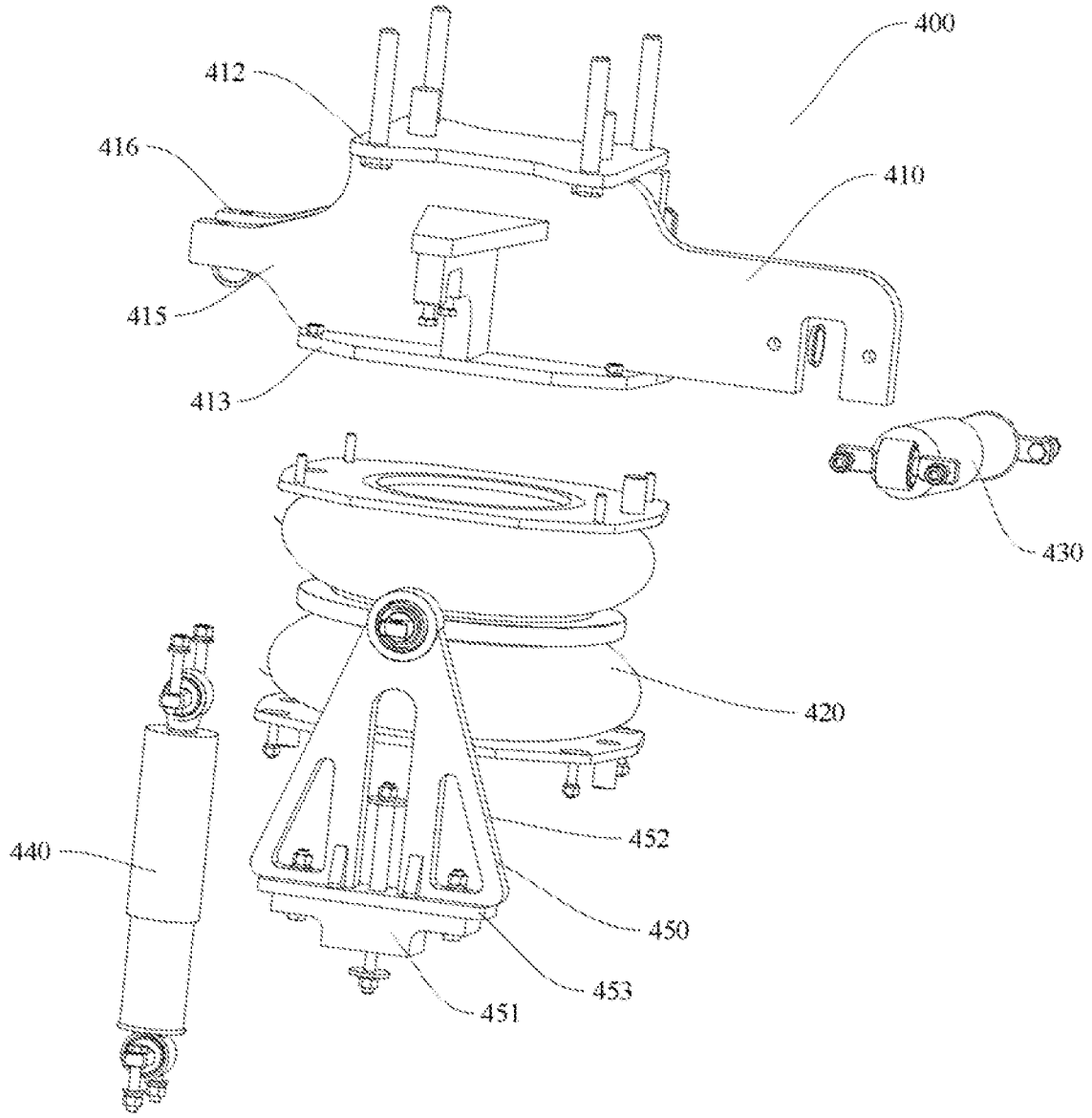
FIG. 7 is an explosive view of the suspension system.

As shown in FIG. 7 and FIG. 8, the vehicle body connecting seat 410 may include an upper plate 412, a lower plate 413 and a web plate, the web plate is vertically connected between the upper plate 412 and the lower plate 413, the upper plate 412 is suitable for being connected to the vehicle body 2000, the lower plate 413 is suitable for being fixedly connected to the upper end of the elastic component 420, and the surface of the upper plate 412 facing the vehicle body 2000 is provided with a buffer cushion 414. The buffer cushion 414 can achieve damping and buffering effects between the vehicle body 2000 and the suspension system 400, so that vibration of the rail vehicle in the traveling process can be reduced, and the noise of the rail vehicle in the traveling process can be reduced. The buffer cushion 414 may be a rubber cushion. As shown in FIG. 8, the shape of the buffer cushion 414 is the same as the shape of the upper plate 412. Thus, on the one hand, the buffer cushion 414 can achieve a reliable buffering effect between the vehicle body 2000 and the upper plate 412, and on the other hand, the buffer cushion 414 and the upper plate 412 can be fixed simply and reliably.

The web plate may be used for being connected to other components in the suspension system 400, and there may be a plurality of web plates arranged in parallel. On the one hand, the plurality of web plates can enhance the connecting strength between the upper plate 412 and the lower plate 413, and on the other hand, the plurality of web plates are convenient to be fixedly connected to other components in the suspension system 400. As shown in FIG. 8, two web plates may be arranged and are respectively a long web plate 415 and a short web plate 416 with different lengths, the extended length of the long web plate 415 is greater than the extended length of the short web plate 416, one end (rear end in FIG. 8) of the long web plate 415 is hinged to the transverse damper 430, the other end (front end in FIG. 8) of the long web plate 415 and one end (front end in FIG. 8) of the short web plate 416 are both hinged to the vertical damper 440, and the front end of the long web plate 415 is adjacent to the front end of the short web plate 416. Thus, the connecting reliability between the transverse damper 430 and the vertical damper 440 and the vehicle body connecting seat 410 can be ensured.

In addition, as shown in FIG. 8, the surface of the short web plate 416 back on to the long web plate 415 is provided with the suspension stop component 411. When the vehicle body shakes left and right, the suspension stop component 411 and the transverse stop mounting seat 111 are mutually abutted so as to stabilize the vehicle body 2000. The suspension stop component 411 can include the rubber cushion. The rubber cushion can buffer collision between the suspension stop component 411 and the transverse stop mounting seat 111 so as to enhance the structural reliability of the bogie assembly 1000.

As shown in FIG. 8, the surface of the long web plate 415 back on to the short web plate 416 may be provided with a limiting bracket mounting plate, and the elastic component limiting bracket 450 is hinged on the limiting bracket mounting plate.

In some embodiments of the present disclosure, the upper plate 412, the web plate and the lower plate 413 may be in welded connection. Thus, the structural integrity of the vehicle body connecting seat 410 is better, the mounting mode of the vehicle body connecting seat 410 is simple, and the mounting efficiency of the vehicle body connecting seat 410 is high.

Figure 15:
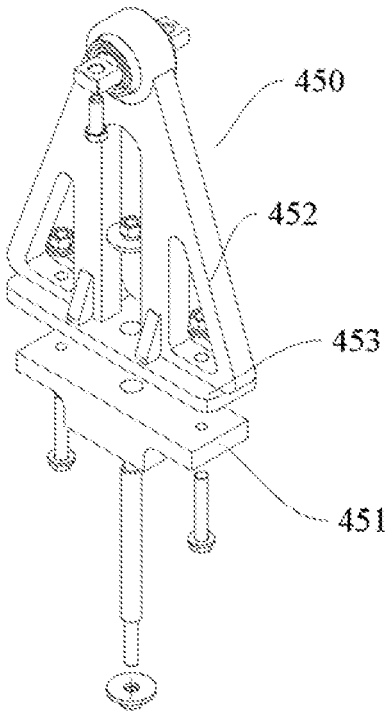
FIG. 15 is a structural schematic diagram of an elastic component limiting bracket.

As shown in FIG. 15, the lower end of the elastic component limiting bracket 450 may be provided with a damping cushion 451, and the damping cushion 451 and the suspension support seat 120 are fixed, for example, through a fastener. In an embodiment, the fastener can sequentially penetrate through the suspension support seat 120 and the damping cushion 451 of the elastic component limiting bracket 450 so as to fix the damping cushion 451 and the suspension support seat 120. By arrangement of the damping cushion 451, rigid collision and impact between the suspension support seat 120 and the elastic component limiting bracket 450 can be reduced, so that the structural reliability of the bogie assembly 1000 can be enhanced, and the noise generated between the suspension support seat 120 and the elastic component limiting bracket 450 can be reduced. In some embodiments of the present disclosure, the damping cushion 451 of the elastic component limiting bracket 450 may be the rubber cushion.

As shown in FIG. 15, part of the damping cushion 451 of the elastic component limiting bracket 450 protrudes to form a bulge, and a groove matched with the bulge is formed in the suspension support seat 120. The bulge can be matched in the groove, thus on the one hand, the assembly between the damping cushion 451 of the elastic component limiting bracket 450 and the suspension support seat 120 can be facilitated, and on the other hand, the damping effect of the damping cushion 451 of the elastic component limiting bracket 450 can be enhanced so as to better reduce the noise generated by the bogie assembly 1000.

The elastic component limiting bracket 450 may be substantially triangular, the vertex of the elastic component limiting bracket 450 is hinged to the vehicle body connecting seat 410, and the bottom edge of the elastic component limiting bracket 450 is provided with a plurality of mounting holes for fasteners to penetrate through. The connecting area between the bottom edge of the elastic component limiting bracket 450 and the suspension support seat 120 is larger, so that the stress of all parts is uniform, the connecting reliability between the elastic component limiting bracket 450 and the suspension support seat 120 can be enhanced, and further, the structural reliability of the bogie assembly 1000 can be enhanced.

The elastic component limiting bracket 450 can be configured to be of a platy structure, and the elastic component limiting bracket 450 may be provided with a fastener avoiding hole. Thus, the fastener can conveniently extend into the corresponding mounting hole, and the fastener avoiding hole can also reduce the weight of the elastic component limiting bracket 450 at least to some extent so as to enable the rail vehicle to meet the requirement for light weight.

As shown in FIG. 15, the elastic component limiting bracket 450 may include a limiting component body 452 and a limiting component bottom plate 453, the upper end of the limiting component body 452 is hinged to the vehicle body connecting seat 410, the limiting component bottom plate 453 is connected to the limiting component body 452, and the limiting component bottom plate 453 is provided with a mounting hole. The limiting component bottom plate 453 corresponds to the damping cushion 451, so that the damping cushion 451 can achieve a damping effect between the limiting component bottom plate 453 and the suspension support seat 120.

In addition, as shown in FIG. 15, a support column is connected between the limiting component body 452 and the limiting component bottom plate 453. The support column can enhance the structural strength of the elastic component limiting bracket 450 at least to some extent and can prolong the service life of the elastic component limiting bracket 450.

The elastic component limiting bracket 450 can be arranged at one side of the suspension system 400 away from the bogie body 110. Thus, the position of the elastic component limiting bracket 450 is reasonable, the structural integrity of the suspension system 400 is better, and the structural stability of the bogie assembly 1000 can be enhanced.

The horizontal wheel is described in detail below. The horizontal wheel includes a guide wheel 500 and a steady wheel 600.

The bogie frame 100 is provided with a horizontal wheel mounting seat, the horizontal wheel mounting seat may include a guide wheel mounting seat 130 and a steady wheel mounting seat 140, the guide wheel mounting seat 130 corresponds to the guide wheel 500, and the steady wheel mounting seat 140 corresponds to the steady wheel 600. The guide wheel mounting seats 130 may be arranged on the bogie body 110. For example, the guide wheel mounting seat 130 may be arranged on the first connecting beam 112 and the third connecting beam 114. In an embodiment, the first connecting beam 112 may be provided with two guide wheel mounting seats 130 spaced apart, and the third connecting beam 114 may be provided with two guide wheel mounting seats 130 spaced apart. The steady wheel mounting seat 140 may be arranged at the bottom of the suspension support seat 120, and each suspension support seat 120 corresponds to one steady wheel mounting seat 140.

The horizontal wheel is detachably mounted on the horizontal wheel mounting seats. For example, the horizontal wheel may be fixedly connected to the corresponding horizontal wheel mounting seat through a fastener, where there may be a plurality of fasteners so as to ensure the fixed reliability between the horizontal wheel and the horizontal wheel mounting seat.

As shown in FIGS. 2, 3, 13 and 14, the bogie assembly 1000 may also include an adjusting shim, and the adjusting shim is inserted between the horizontal wheel and the horizontal wheel mounting seat. The adjusting shim may include a guide wheel adjusting shim 510 and a steady wheel adjusting shim, the guide wheel adjusting shim 510 is inserted between the guide wheel 500 and the guide wheel mounting seat 130, and the steady wheel adjusting shim may be arranged between the steady wheel 600 and the steady wheel mounting seat 140. It can be understood that with the traveling of the rail vehicle, the peripheral surfaces of the steady wheel 600 and the guide wheel 500 abut against the rail beam 3000 all the time, so that the steady wheel 600 and the guide wheel 500 are in a worn state all the time until a gap between the guide wheel 500 and the rail beam 3000 and a gap between the steady wheel 600 and the rail beam 3000 are respectively formed. In this case, the effects of the steady wheel 600 and the guide wheel 500 are reduced or even gradually lost, so that the distance between the steady wheel 600 and the rail beam 3000 and the distance between the guide wheel 500 and the rail beam 3000 need to be adjusted to eliminate the gaps. Under such condition, the corresponding adjusting shim can be dismounted to reduce the distances between the center of the steady wheel 600 and the rail beam 3000 and the distance between the center of the guide wheel 500 and the rail beam 3000, so that the steady wheel 600 and the guide wheel 500 can be kept in contact with the rail beam 3000 respectively, keeping the effects of the steady wheel 600 and the guide wheel 500. In some embodiments of the present disclosure, there may be a plurality of adjusting shims, and one adjusting shim can be dismounted in each adjusting process so as to enable the steady wheel 600 and the guide wheel 500 to be kept in contact with the rail beam 3000 without replacing the guide wheel 500 and the steady wheel 600.

Figure 2:
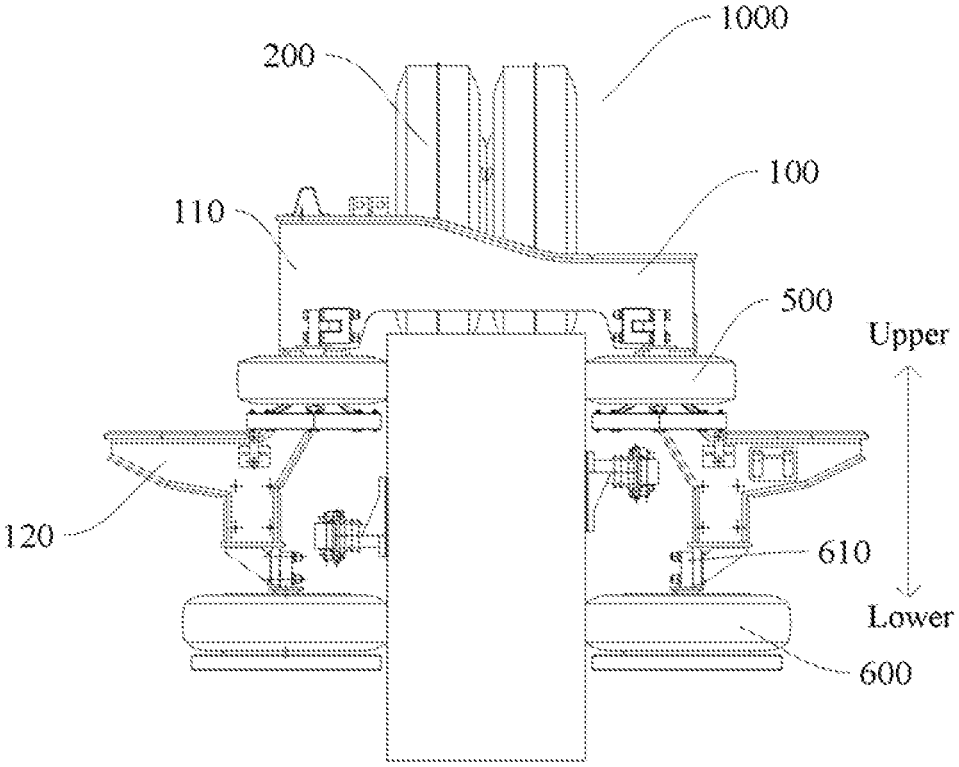
FIG. 2 is a front view of the bogie assembly and the rail beam according to the embodiments of the present disclosure.
Figure 13:
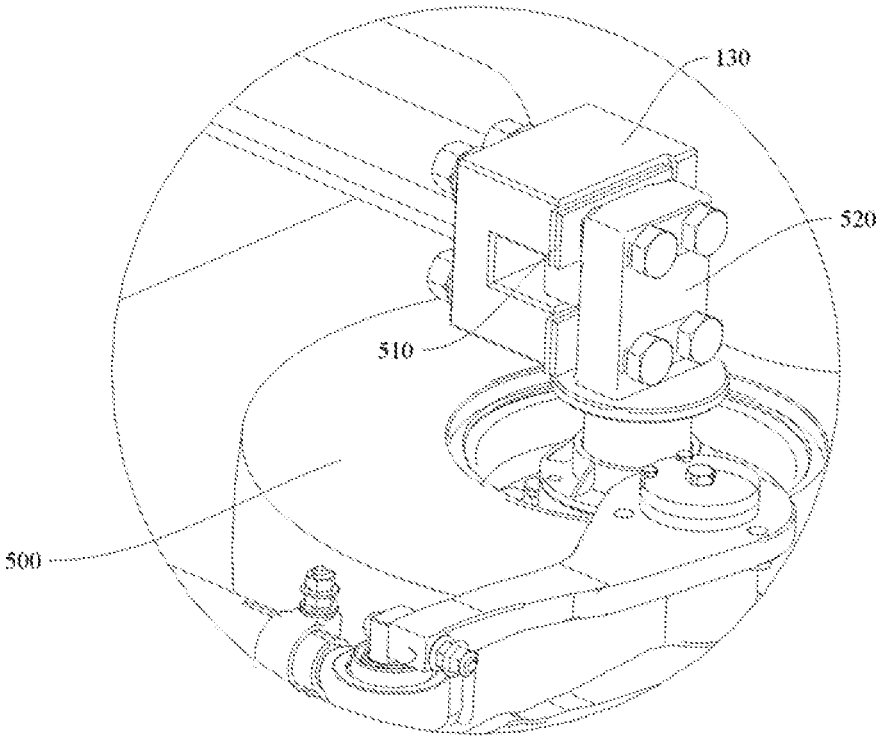
FIG. 13 is an enlarged view of a region Ain FIG. 1.

A mounting block is arranged on the horizontal wheel and is fixed onto the horizontal wheel mounting seat through a fasteners so as to fix the horizontal wheel onto the horizontal wheel mounting seat, and the fastener penetrates through the adjusting shim. In some embodiments of the present disclosure, the guide wheel 500 may be provided with a guide wheel mounting block 520, and the steady wheels 600 may be provided with a steady wheel mounting block 610. As shown in FIG. 13, the fastener sequentially penetrates through the guide wheel mounting block 520, the guide wheel adjusting shim 510 and the guide wheel mounting seat 130 so as to fix the three together, so that the guide wheel 500 can be fixed on the bogie body 110. Similarly, as shown in FIG. 2, the fastener sequentially penetrates through the steady wheel mounting block 610, the steady wheel adjusting shim and the steady wheel mounting seat 140 so as to fix the three together, so that the steady wheel 600 can be fixed at the bottom of the suspension support seat 120.

Figure 14:
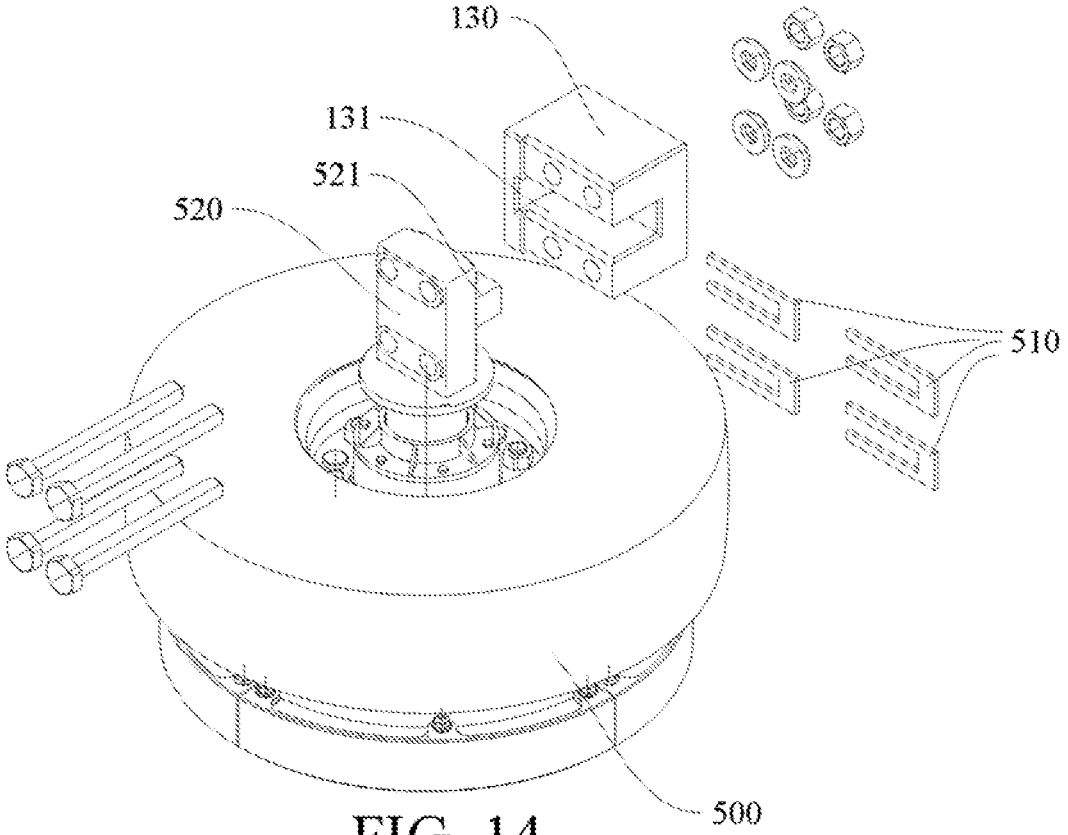
FIG. 14 is an exploded view of the guide wheel and the guide wheel mounting seat.

In some embodiments of the present disclosure, the mounting block may be provided with a first pre-positioning component, the horizontal wheel mounting seat may be provided with a second pre-positioning component, and the first pre-positioning component is suitable for being matched with the second pre-positioning component. As shown in FIG. 14, taking the guide wheel 520 as an example, the guide wheel mounting block 520 may be provided with the first pre-positioning component 521, the guide wheel mounting seat 130 may be provided with the second pre-positioning component 131, and the first pre-positioning component 521 is suitable for being matched with the second pre-positioning component 131. In the mounting process of the guide wheel 500, the first pre-positioning component 521 may be matched with the second pre-positioning component 131 in advance to realize pre-positioning mounting between the guide wheel mounting block 520 and the guide wheel mounting seat 130, so that the guide wheel mounting block 520 and the guide wheel mounting seat 130 can be conveniently fixed through the fastener, and further, the mounting efficiency of the guide wheel 500 can be enhanced.

Similarly, in the mounting process of the steady wheel 600, the first pre-positioning component of the steady wheel mounting block 610 may be matched with the second pre-positioning component of the steady wheel mounting seat 140 in advance to realize pre-positioning mounting between the steady wheel mounting block 610 and the steady wheel mounting seat 140, so that the steady wheel mounting block 610 and the steady wheel mounting seat 140 can be conveniently fixed through the fasteners, and further, the mounting efficiency of the steady wheel 600 can be enhanced.

In some embodiments of the present disclosure, one of the first pre-positioning component and the second pre-positioning component is a bulge, the other one is a groove, and the bulge is suitable for being matched with the groove. For example, as shown in FIG. 14, the first pre-positioning component 521 of the guide wheel mounting block 520 may be a bulge, the second pre-positioning component 131 of the guide wheel mounting seat 130 may be a groove, and the bulge may extend into the groove in advance so as to realize pre-positioning of the guide wheel mounting seat 130 to the guide wheel mounting block 520 in the up-and-down direction, so that the guide wheel mounting block 520 and the corresponding guide wheel mounting seat 130 can be conveniently fixed through the fastener. Similarly, the first pre-positioning component of the steady wheel mounting block 610 and the second pre-positioning component of the steady wheel mounting seat 140 also have the similar structures, and the descriptions thereof are omitted herein.

An avoiding groove for avoiding a fastener is formed in the adjusting shim, and one end of the avoiding groove is opened. It can be understood that in the process of dismounting the adjusting shim, the fastener does not need to be completely removed from the mounting block and the horizontal wheel mounting seat, and the fastener may be unscrewed to release the mounting block and the horizontal wheel mounting seat to enable the adjusting shim to have an activity gap, so that a worker can dismount one of the plurality of adjusting shims by using a tool and then tighten the fastener. By forming the avoiding groove in the adjusting shim, the adjusting shim can be dismounted simply and conveniently, so that the reliability of the guide wheel 500 and the steady wheel 600 can be better enhanced.

In some embodiments of the present disclosure, fasteners may be arranged above and below the first pre-positioning components (the first pre-positioning component 521 of the guide wheel mounting block 520 and the first pre-positioning component of the steady wheel mounting block 610), and the numbers of the adjusting shims above and below the first pre-positioning components are identical.

At one side of the rail beam 3000, the steady wheel 600 is positioned between two guide wheels 500. For an example, each side of the rail beam 3000 may be provided with one steady wheel 600 and two guide wheels 500, the two guide wheels 500 are respectively arranged on the first connecting beam 112 and the third connecting beam 114, and the steady wheel 600 is positioned on the suspension support seat 120 below the second connecting beam 113 or the fourth connecting beam 115, thus in the front-and-rear direction, the steady wheel 600 is positioned between the two guide wheels 500, and in the up-and-down direction, the steady wheel 600 is lower than the two guide wheels 500. By the reasonable arrangement of the guide wheel 500 and the steady wheel 600, the traveling stability of the rail vehicle is better.

The diameter of the steady wheel 600 may be greater than the diameter of the guide wheel 500, so that the body stability of the vehicle in traveling and turning processes can be enhanced. The central axis of the steady wheel 600 is positioned at the outer side of the central axis of the guide wheel 500, where the outer and inner sides are defined according to the distances from the rail beam 3000. Thus, the steady wheel 600 and the guide wheel 500 can be tightly matched to the rail beam 3000, and the steady wheel 600 and the guide wheel 500 can ensure that a sufficient insulation space is reserved between the bogie frame 100 and the rail beam 3000, so that the insulation space can ensure insulation between the rail beam 3000 and the conductor rail and can ensure insulation between the conductor rail and the bogie frame 100, thereby further enhancing the traveling safety of the rail vehicle.

As shown in FIG. 2, thereby may be four guide wheels 500, and thereby may be two steady wheels 600. The four guide wheels 500 may be positioned at the same height, and the two steady wheels 600 are positioned at another same height and symmetrically arranged about the rail beam 3000, where the height of the steady wheel 600 is less than the height of the guide wheel 500. Thus, the structural reliability of the rail vehicle can be enhanced, and the four guide wheels 500 and the two steady wheels 600 can ensure the traveling safety of the rail vehicle.

The rail vehicle according to the embodiments of the present disclosure includes the bogie assembly 1000 described in the above embodiments.

In the descriptions of this specification, descriptions such as reference terms "an embodiment", "some embodiments", "example", "specific example", or "some examples" intend to indicate that specific features, structures, materials, or characteristics described with reference to embodiments or examples are included in at least one embodiment or example of the present disclosure. In this specification, schematic descriptions of the foregoing terms do not need to aim at a same embodiment or example. Besides, the specific features, the structures, the materials or the characteristics that are described may be combined in a proper manner in any one or more embodiments or examples. In addition, in a case that is not mutually contradictory, persons skilled in the art can combine or group different embodiments or examples that are described in this specification and features of the different embodiments or examples.

Although the embodiments of the present disclosure are shown and described above, it may be understood that the foregoing embodiments are examples, and cannot be understood as limitations to the present disclosure. A person of ordinary skill in the art may make changes, modifications, replacements, and variations to the foregoing embodiments without departing from the scope of the present disclosure.

What is claimed is:

1. A suspension system, comprising:

a vehicle body connecting seat, an elastic component, an elastic component limiting bracket, a transverse damper, and a vertical damper, wherein:

the vehicle body connecting seat is positioned above the elastic component and is connected to the elastic component, and the transverse damper and the vertical damper are respectively hinged to the vehicle body connecting seat and are perpendicular to each other;

the elastic component limiting bracket is connected to the vehicle body connecting seat and is positioned at one side of the elastic component; and the elastic component limiting bracket comprises a limiting component body and a limiting component bottom plate, wherein the upper end of the limiting component body is hinged to the vehicle body connecting seat, and the limiting component bottom plate is connected to the limiting component body and is provided with mounting holes.

2. The suspension system according to claim 1, wherein the transverse damper and the vertical damper are respectively positioned at two sides of the elastic component.

3. The suspension system according to claim 1, wherein:

the elastic component limiting bracket is substantially triangular, and the bottom plate of the elastic component limiting bracket is provided with the mounting holes for fasteners to penetrate through.

4. The suspension system according to claim 3, wherein the elastic component limiting bracket is configured to be of a platy structure and is provided with a fastener avoiding hole.

5. The suspension system according to claim 1, wherein a support column is connected between the limiting component body and the limiting component bottom plate.

6. The suspension system according to claim 1, wherein:
the vehicle body connecting seat comprises an upper plate, a lower plate and a web plate,
the web plate is vertically connected between the upper plate and the lower plate,
the upper plate is suitable for being fixedly connected to the vehicle body,
the lower plate is fixedly connected to the upper end of the elastic component, and
the transverse damper and the vertical damper are respectively connected to the web plate.

7. The suspension system according to claim 6, wherein the surface of the upper plate facing the vehicle body is provided with a buffer cushion, and the shape of the buffer cushion is the same as the shape of the upper plate.

8. The suspension system according to claim 6, wherein:
two web plates are arranged and are respectively a long web plate and a short web plate with different lengths,
one end of the long web plate is hinged to the transverse damper,
the other end of the long web plate and one end of the short web plate are both hinged to the vertical damper, and
the one end of the short web plate is adjacent to the other end of the long web plate.

9. A bogie assembly, comprising:
a bogie frame, wherein the bogie frame comprises a bogie body and a suspension support seat connected to the bogie body; and
a suspension system including a vehicle body connecting seat, an elastic component, an elastic component limiting bracket, a transverse damper, and a vertical damper, wherein the vehicle body connecting seat is positioned above the elastic component and is connected to the elastic component, and the transverse damper and the vertical damper are respectively hinged to the vehicle body connecting seat and are perpendicular to each other,
wherein the lower end of the elastic component of the suspension system and the lower end of the vertical damper are respectively connected to the suspension support seat, and the transverse damper of the suspension system is connected to the bogie body,
wherein the elastic component limiting bracket is connected to the vehicle body connecting seat and is positioned at one side of the elastic component,
wherein the elastic component limiting bracket comprises a limiting component body and a limiting component bottom plate, the upper end of the limiting component body being hinged to the vehicle body connecting seat, and the limiting component bottom plate being connected to the limiting component body and being provided with mounting holes.

10. The bogie assembly according to claim 9, two suspension support seats are arranged and are respectively connected to two opposite sides of the bogie body, and two suspension systems are arranged and are in one-to-one correspondence to two suspension support seats.

11. The bogie assembly according to claim 10, wherein the two suspension systems are symmetrically arranged about the center of the bogie frame.

12. The bogie assembly according to claim 9, wherein the bogie body is provided with a transverse stop mounting seat, the vehicle body connecting seat is provided with a suspension stop component corresponding to the transverse stop mounting seat, and the suspension stop component is suitable for being matched with the transverse stop mounting seat.

13. The bogie assembly according to claim 9, wherein
the vehicle body connecting seat comprises an upper plate, a lower plate and a web plate,
the web plate is vertically connected between the upper plate and the lower plate,
the upper plate is suitable for being fixedly connected to the vehicle body,
the lower plate is fixedly connected to the upper end of the elastic component,
the transverse damper and the vertical damper are respectively connected to the web plate,
two web plates are arranged and are respectively a long web plate and a short web plate with different lengths,
one end of the long web plate is hinged to the transverse damper,
the other end of the long web plate and one end of the short web plate are both hinged to the vertical damper,
the one end of the short web plate is adjacent to the other end of the long web plate, and
the surface of the short web plate back on to the long web plate is provided with a suspension stop component.

14. The bogie assembly according to claim 9, wherein the bogie body is provided with an avoiding groove for avoiding the transverse damper.

15. The bogie assembly according to claim 9, wherein
the elastic component limiting bracket is fixedly connected to the suspension support seat.

16. The bogie assembly according to claim 15, wherein a damping cushion is arranged at the lower end of the elastic component limiting bracket, and the damping cushion is fixedly connected to the suspension support seat.

17. A rail vehicle, comprising:
a vehicle body; and
a bogie assembly including a bogie frame, wherein the bogie frame comprises a bogie body and a suspension support seat connected to the bogie body; and a suspension system including a vehicle body connecting seat, an elastic component, an elastic component limiting bracket, a transverse damper, and a vertical damper, wherein the vehicle body connecting seat is positioned above the elastic component and is connected to the elastic component, and the transverse damper and the vertical damper are respectively hinged to the vehicle body connecting seat and are perpendicular to each other, the elastic component limiting bracket is connected to the vehicle body connecting seat and is positioned at one side of the elastic component, the elastic component limiting bracket comprising a limiting component body and a limiting component bottom plate, the upper end of the limiting component body being hinged to the vehicle body connecting seat, and the limiting component bottom plate being connected to the limiting component body and being provided with mounting holes,
wherein the lower end of the elastic component of the suspension system and the lower end of the vertical damper are respectively connected to the suspension support seat, and the transverse damper of the suspension system is connected to the bogie body, and
wherein the vehicle body is mounted on the bogie assembly.

* * * * *